US008567086B2

(12) United States Patent
Kanai

(10) Patent No.: US 8,567,086 B2
(45) Date of Patent: Oct. 29, 2013

(54) CONTINUOUS DRYING APPARATUS

(76) Inventor: Masao Kanai, Yokohama (JP)

( * ) Notice: Subject to any disclaimer, the term of this patent is extended or adjusted under 35 U.S.C. 154(b) by 727 days.

(21) Appl. No.: 12/706,984

(22) Filed: Feb. 17, 2010

(65) Prior Publication Data

US 2010/0223802 A1 Sep. 9, 2010

(30) Foreign Application Priority Data

Mar. 3, 2009 (JP) ..... 2009-48741

(51) Int. Cl.
*F26B 17/18* (2006.01)

(52) U.S. Cl.
USPC ..... 34/59; 34/102; 34/167; 34/182

(58) Field of Classification Search
USPC ..... 34/59, 167, 61, 182, 102; 366/136, 137, 366/131, 134, 133, 147, 159.1, 22, 156.1, 366/156.2, 158.3, 144, 234; 422/620, 622; 198/786, 666, 669, 676, 562, 657, 662, 198/671; 110/115, 224, 225; 165/112
See application file for complete search history.

(56) References Cited

U.S. PATENT DOCUMENTS 2,289,917 A * 7/1942 Lambiotte ..... 201/34
3,075,298 A * 1/1963 Schaub ..... 34/166
3,143,336 A * 8/1964 Byberg ..... 366/156.1
3,442,769 A * 5/1969 Heinz ..... 203/7
3,529,939 A * 9/1970 Mason ..... 422/273
3,646,688 A * 3/1972 Osterman ..... 34/168
3,669,416 A * 6/1972 Sutter et al. ..... 366/145
3,946,996 A * 3/1976 Gergely ..... 366/139
4,133,714 A * 1/1979 Vorobiev et al. ..... 162/237
4,197,016 A * 4/1980 Winterhalter et al. ..... 366/165.5
4,203,961 A * 5/1980 Cowley ..... 423/478
4,245,399 A * 1/1981 Muller et al. ..... 34/166
4,286,883 A * 9/1981 Johanson ..... 366/137
4,291,128 A * 9/1981 Elmore et al. ..... 521/54
4,329,202 A * 5/1982 White et al. ..... 201/27
4,366,122 A * 12/1982 Elmore et al. ..... 422/133
4,371,375 A * 2/1983 Dennis et al. ..... 34/505
4,372,053 A * 2/1983 Anderson et al. ..... 34/378
4,481,721 A * 11/1984 Graff ..... 34/500
5,052,874 A * 10/1991 Johanson ..... 414/326
5,056,455 A * 10/1991 Ritz ..... 118/17
5,129,316 A * 7/1992 Calderon ..... 99/472
5,185,060 A * 2/1993 Yamasaki et al. ..... 159/13.1
5,188,808 A * 2/1993 Lilja et al. ..... 422/229

(Continued)

FOREIGN PATENT DOCUMENTS

JP 2840639 10/1998

*Primary Examiner* — Jiping Lu
(74) *Attorney, Agent, or Firm* — Kubotera & Associates, LLC

(57) ABSTRACT

The inner space of a drying tank 4 is made up of a mixing and drying zone MZ to mix and dry supplied material 3 by swirling the material 3 upward onto rotor blades 5 and pressing the material centrifugally against a heated cylindrical inner surface of the tank wall 2, and a drying zone DZ beneath the mixing and drying zone MZ. An upper screw conveyer 15, connected to the upper part of the mixing and drying zone MZ transfers material 3 out of the drying tank 4. A lower screw conveyer 13, connected to the bottom of the mixing and drying zone MZ transfers material received from the upper conveyor 15 through a vertical transfer pipe 17 back into the drying tank 4 along with new material to be dried. A discharge screw conveyer 21 is connected to the drying zone DZ to discharge out dried material continuously.

4 Claims, 12 Drawing Sheets

(56) References Cited

U.S. PATENT DOCUMENTS

| | | | | | |
|---|---|---|---|---|---|
| 5,240,328 | A * | 8/1993 | Krambrock | 366/341 |
| 5,251,383 | A * | 10/1993 | Williams | 34/386 |
| 5,277,490 | A * | 1/1994 | Boon | 366/4 |
| 5,333,396 | A * | 8/1994 | Kanai | 34/166 |
| 5,391,000 | A * | 2/1995 | Taniguchi | 366/332 |
| 5,447,369 | A * | 9/1995 | Boxall | 366/136 |
| 5,467,535 | A * | 11/1995 | Lentz | 34/168 |
| 5,561,917 | A * | 10/1996 | Ratajczek | 34/384 |
| 5,586,396 | A * | 12/1996 | Kanai | 34/59 |
| 5,662,775 | A * | 9/1997 | Marcoccia et al. | 162/41 |
| 5,806,205 | A * | 9/1998 | Varvat | 34/181 |
| 5,940,982 | A * | 8/1999 | Braun | 34/182 |
| 6,105,275 | A * | 8/2000 | Aulbaugh et al. | 34/424 |
| 6,129,450 | A * | 10/2000 | Braun | 366/83 |
| 6,129,897 | A * | 10/2000 | Neelakantan | 422/139 |
| 6,143,253 | A * | 11/2000 | Radcliffe et al. | 422/145 |
| 6,230,421 | B1 * | 5/2001 | Reed et al. | 34/401 |
| 6,283,275 | B1 * | 9/2001 | Morris et al. | 198/677 |
| 6,296,384 | B1 * | 10/2001 | Yatomi et al. | 366/147 |
| 6,322,761 | B1 * | 11/2001 | Yamauchi et al. | 422/234 |
| 6,358,480 | B1 * | 3/2002 | Kuroki | 422/184.1 |
| 6,370,797 | B1 * | 4/2002 | Crawford | 34/475 |
| 6,510,305 | B1 * | 1/2003 | Franzen et al. | 399/258 |
| 6,758,150 | B2 * | 7/2004 | Ballantine et al. | 110/229 |
| 6,807,915 | B2 * | 10/2004 | Sugano et al. | 110/233 |
| 6,938,357 | B2 * | 9/2005 | Hauch | 34/168 |
| 7,293,909 | B2 * | 11/2007 | Taniguchi | 366/118 |
| 7,325,966 | B2 * | 2/2008 | Gassenschmidt | 366/136 |
| 7,347,007 | B2 * | 3/2008 | Maguire | 34/493 |
| 7,350,964 | B2 * | 4/2008 | Wellenbrock et al. | 366/261 |
| 7,396,151 | B2 * | 7/2008 | Hermsmeyer et al. | 366/158.1 |
| 7,404,665 | B2 * | 7/2008 | Bacher et al. | 366/76.9 |
| 7,448,790 | B2 * | 11/2008 | Tessien et al. | 366/114 |
| 7,452,392 | B2 * | 11/2008 | Nick et al. | 48/198.1 |
| 7,574,816 | B2 * | 8/2009 | Shivvers | 34/333 |
| 7,579,385 | B1 * | 8/2009 | Yamakoshi et al. | 521/62 |
| 7,585,102 | B2 * | 9/2009 | Bacher et al. | 366/147 |
| 7,743,912 | B2 * | 6/2010 | Finley | 198/666 |
| 7,842,221 | B2 * | 11/2010 | Magni et al. | 264/322 |
| 7,943,099 | B2 * | 5/2011 | Strebelle et al. | 422/234 |
| 8,231,264 | B2 * | 7/2012 | Tiesnitsch | 366/133 |
| 2004/0076726 | A1 * | 4/2004 | Lucas | 426/510 |
| 2004/0172996 | A1 * | 9/2004 | Matsui | 71/8 |
| 2004/0202744 | A1 * | 10/2004 | Bacher et al. | 425/207 |
| 2006/0120212 | A1 * | 6/2006 | Taniguchi et al. | 366/118 |
| 2008/0022547 | A1 * | 1/2008 | Shivvers | 34/333 |
| 2009/0094853 | A1 * | 4/2009 | Noyes et al. | 34/233 |
| 2010/0034050 | A1 * | 2/2010 | Erb et al. | 366/342 |
| 2011/0008241 | A1 * | 1/2011 | Maskarinec et al. | 423/449.1 |
| 2011/0232124 | A1 * | 9/2011 | Shivvers | 34/428 |
| 2011/0308100 | A1 * | 12/2011 | Holmes et al. | 34/58 |
| 2012/0064619 | A1 * | 3/2012 | De Baere et al. | 435/290.4 |

* cited by examiner

CONTINUOUS DRYING APPARATUS

CROSS-REFERENCE TO RELATED APPLICATION

This application claims priority on the basis of Japanese patent application 48741/2009, filed Mar. 3, 2009. The disclosure of Japanese application 48741/2009 is hereby incorporated by reference.

FIELD OF THE INVENTION

This invention relates to a drying apparatus with rotor blades that slope upward in a direction opposite to their direction of rotation. It relates more specifically to a drying apparatus which utilizes such rotor blades, and which is capable of carrying out continuous drying.

BACKGROUND OF THE INVENTION

Japanese Patent No. 2840639 provides a conventional drying apparatus which dries various kinds of materials in the form of grains, powder, liquid, blocks and other forms of material. Material is introduced into a drying tank of the drying apparatus by a feed screw within a supply pipe connected to the bottom of the tank, swirled up by a set of rotor blades, and pressed centrifugally against a heating surface. Material is pushed upward in the tank by following material, and thus material is sent upward and dried. The dried material is transferred out of the drying tank by a discharge screw.

The conventional drying apparatus described in Japanese Patent No. 2840639 is distinguished by its high drying efficiency. However its operational efficiency is limited by the fact that it is a batch mode machine that operates intermittently.

An objective of the present invention is to provide a drying apparatus which is capable of drying materials continuously, thereby improving drying efficiency.

SUMMARY OF THE INVENTION

To achieve the above-mentioned objective, the invention provides a continuous drying apparatus which comprises a vertical cylindrical drying tank, heating means surrounding the drying tank and heating the inner surface of the drying tank to transfer heat from the heating means to material to be dried, and rotor blades mounted for rotation in the drying tank in order to swirl material upward by their rotation and bring the material into contact with the heating surface.

A characterizing feature of the drying apparatus according to the invention is that the inner space of the drying tank is made up of a mixing and drying zone, and a drying zone below the mixing and drying zone. Material supplied to the mixing and drying zone is swirled upward by one or more rotor blades and, because the material rotates as it moves upward, it is pressed centrifugally against the heating surface.

An upper screw conveyer, connected to the upper part of the mixing and drying zone transfers material swirled up by rotation of the one or more rotor blades out of the mixing and drying zone.

A lower screw conveyer is connected to a middle part of the drying tank to supply materials into the drying tank, and a vertical transfer pipe is connected between the upper screw conveyer and the lower screw conveyer to transfer materials discharged from the tank by the upper screw conveyer downward to the lower screw conveyer for return to the mixing and drying zone.

A discharge screw conveyer is connected to the drying zone to discharge material continuously from the drying zone.

In this continuous drying apparatus, the material in the mixing and drying zone, which is swirled upward by rotating rotor blades, is returned to a lower part of the mixing and drying zone through the upper screw conveyer, the vertical transfer pipe, and a lower screw conveyer. The material is circulated repeatedly through the upper screw conveyer, the vertical transfer pipe, and the lower screw conveyer to the mixing and drying zone. While repeatedly undergoing this process, the material is gradually dried, and substantially dry material gathers in the drying zone and is transferred out of the drying zone by the discharge screw conveyer. By these sequential processes, the material is continuously dried and discharged with improved efficiency.

In an embodiment of the invention the drying tank has at least one adjunct upper screw conveyer either at same level as that of the first upper screw conveyer or at least above the level of the lower screw conveyer. The drying tank also has at least one adjunct lower screw conveyer at the same level as, or below, the level of the lower screw conveyer. An additional vertical transfer pipe is connected between the adjunct upper and lower screw conveyers to transfer material downward from the adjunct upper screw conveyer to the adjunct lower screw conveyer. The adjunct upper and lower screw conveyors and the additional vertical transfer pipe subject the material to more frequent circulation through the mixing and drying zone, which accelerates mixing and drying.

PREFERRED EMBODIMENTS OF THE INVENTION

The first three embodiments of the invention are described below with reference to FIGS. 1-3 of the accompanying drawings.

Figure 1:
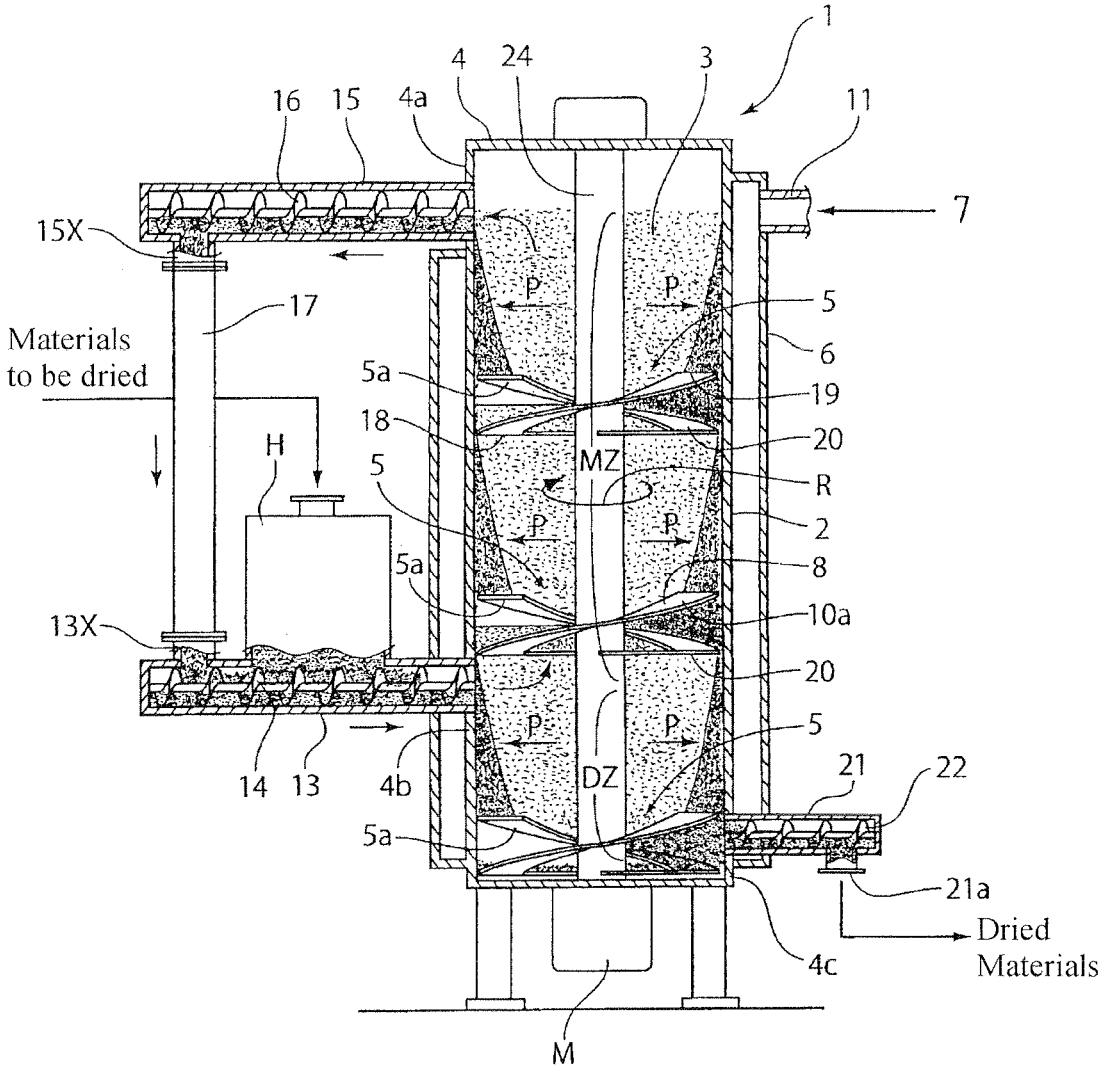
FIG. 1 is a vertical sectional view showing the internal structure of the continuous drying apparatus according to a first embodiment of the invention.

In FIG. 1, which is a vertical sectional view showing the internal structure of a first embodiment of the invention, a continuous drying apparatus 1 comprises a vertical cylindrical drying tank 4 having a cylindrical wall 2 with an inner surface which serves as a heating surface for transfer of heat from a heating means to a material 3 to be dried. The heating means comprises a jacket 6 surrounding the drying tank 4. An inlet 11 of the jacket 6 is connected to a boiler (not shown) which sends steam 7 into the jacket 6. Steam is exhausted from the jacket through a steam outlet (not shown).

Heating means other than a steam jacket and a boiler can be used. An example of an alternative heating means is an electric heater arranged around the drying tank, or a means to send hot air instead of steam into the jacket 6.

The interior space of the drying tank 4 can be divided into two areas: a mixing and drying zone MZ, and a drying zone DZ beneath the mixing and drying zone MZ. In the mixing and drying zone MZ, supplied material 3 is dried by being swirled upward by one or more rotor blades 5*a* and pressed against the cylindrical inner heating surface of wall 2 by centrifugal force P, the force P being an outwardly directed force having a rotating frame of reference.

An upper screw conveyer 15 is connected to the drying tank 4 at a location 4*a* adjacent the top of the mixing and drying zone MZ. The conveyor 15 has a rotating screw 16 therein which transfers out from the top of the mixing and drying zone MZ material 3 which has been swirled upward by rotation of the rotor blades 5. A lower screw conveyer 13 is connected to an intermediate location 4*b* along the vertical length of the drying tank 4. This intermediate location corresponds to the bottom of the mixing and drying zone MZ. The lower screw conveyor 13 has a rotating screw 14 for delivery of material into the drying tank 4, and is equipped with a hopper H, into which the material 3 is supplied.

A hollow, cylindrical, vertical transfer pipe 17 is connected to a connecting port 15X at the bottom of the exit end of the upper screw conveyer 15, and to a connecting port 13X at the top of the lower screw conveyer 13 at a location remote from the drying tank. Hopper H is arranged to supply material into an intermediate part of the lower screw conveyor 13.

A discharge screw conveyer 21 is connected to drying tank 4, and extends outward from a location 4*c* on the outer surface of tank wall 2 adjacent the bottom of the drying zone DZ. The discharge screw conveyor has an outlet 21*a* at the bottom adjacent the outer end thereof, rotating screw 22 therein for continuously transferring dried material out from the drying zone DZ.

The rotor blades 5*a* are arranged in multiple sets 5, disposed preferably at regular intervals along the length of a rotatable central shaft 24 extending vertically (that is, along the direction of gravitational force) through the center of the cylindrical tank 4. Each set 5 consists of a plurality of blades, one set being adjacent the bottom of the tank. The central shaft 24 is driven by a motor M mounted outside of the drying tank 4 below the bottom thereof.

Each blade 5*a* has a surface 8 that extends obliquely upward from a lower end 18 to an upper end 19, proceeding in a direction which is the reverse of the direction R of rotation of the blades. Each blade 5*a* has a length sufficient to transfer material 3 from its lower end 18 to its upper end 19, from which the material 3 is swirled upward. The outer peripheral edge 10*a* of the surface 8 of each blade 5*a* is helical, and conforms to the cylindrical inner heating surface of wall 2, with a clearance allowing rotation of the blades.

The blades 5*a* are arranged so that the upper end 19 of each blade is higher than the lower end 18 of the next following blade 5*a*. The material 3 is dried by being swirled upward by the blades 5*a*, so that a rotating mass of material is formed inside the drying tank. Material in the rotating mass is pressed outward against the heating surface of wall 2 by centrifugal force P.

The continuous drying apparatus 1 operates as follows. The material 3, introduced into the feed port of the hopper H, is supplied to the drying tank 4 by the screw 14 of screw conveyor 13. The materials 3 can be material in any of various forms such as grains, powder, liquid, or blocks.

In the drying zone DZ, the material 3, supplied to the drying tank 4, is transferred by rotation of the blades 5*a* from the lower end 18 to the upper end 19 of each blade on and along the blade's flat surface 8. In this process, the material is forced to travel upward by the elongated, oblique flat surfaces 8, the helical outer peripheral edges 10*a* thereof which extend along the heating surface 2. As a result, the material 3 is swirled upward and pressed against the heating surface by centrifugal force P.

Because the flat surface 8 of each blade 5*a*, which swirls materials 3 upward and presses it against the heating surface 2, is elongated and extends along the heating surface 2, and the outer peripheral edges 10*a* of the blades are helical and conform to the cylindrical heating surface 2 with a clearance, the material 3 is effectively swirled upward and pressed against the heating surface 2 without being crushed.

The material 3 runs upward along the heating surface 2 and is stretch out into a thin layer. The material that reaches the top of the mixing and drying zone MZ is carried out by the upper screw conveyer 15, and then falls down into the lower screw conveyer 13 through the vertical transfer pipe 17. The material dropped into the lower screw conveyer 13, is mixed in the lower screw conveyer 13 with fresh material 3 from hopper H, and the mixture is supplied to the drying tank 4 at the approximate location of the bottom of the mixing and drying zone MZ.

The material 3 is gradually dried while being swirled upward in the drying tank 4. Material with a high water content supplied into the hopper H is mixed with the material circulated from the drying tank and dropped into the lower screw conveyer 13. As a result, the water content of the material drops as a whole. Furthermore, the mixture is sent into the material 3 which is pressed against the heating surface of tank wall 2 as a thin layer stretching over the heating surface. Accordingly, even when material falls downward due to gravitational force after being supplied to the mixing and drying zone by the lower screw conveyer, the material is immediately swirled upward and travels up to the mixing and drying zone MZ. As a result, much of the newly supplied material is dried in the mixing and drying zone MZ, whereas the material 3 in the lower drying zone DZ contains much of the already-dried and powdery materials and a relatively small amount of newly supplied material.

The material 3 at the bottom of the drying tank 4 is transferred through the discharge screw conveyer 21 by screw 22, and continuously discharged from the conveyor outlet 21*a*. Thus, the material 3 is dried continuously, and the amount of material discharged by the screw conveyer 21 corresponds to the amount supplied from the hopper H.

Figure 2:
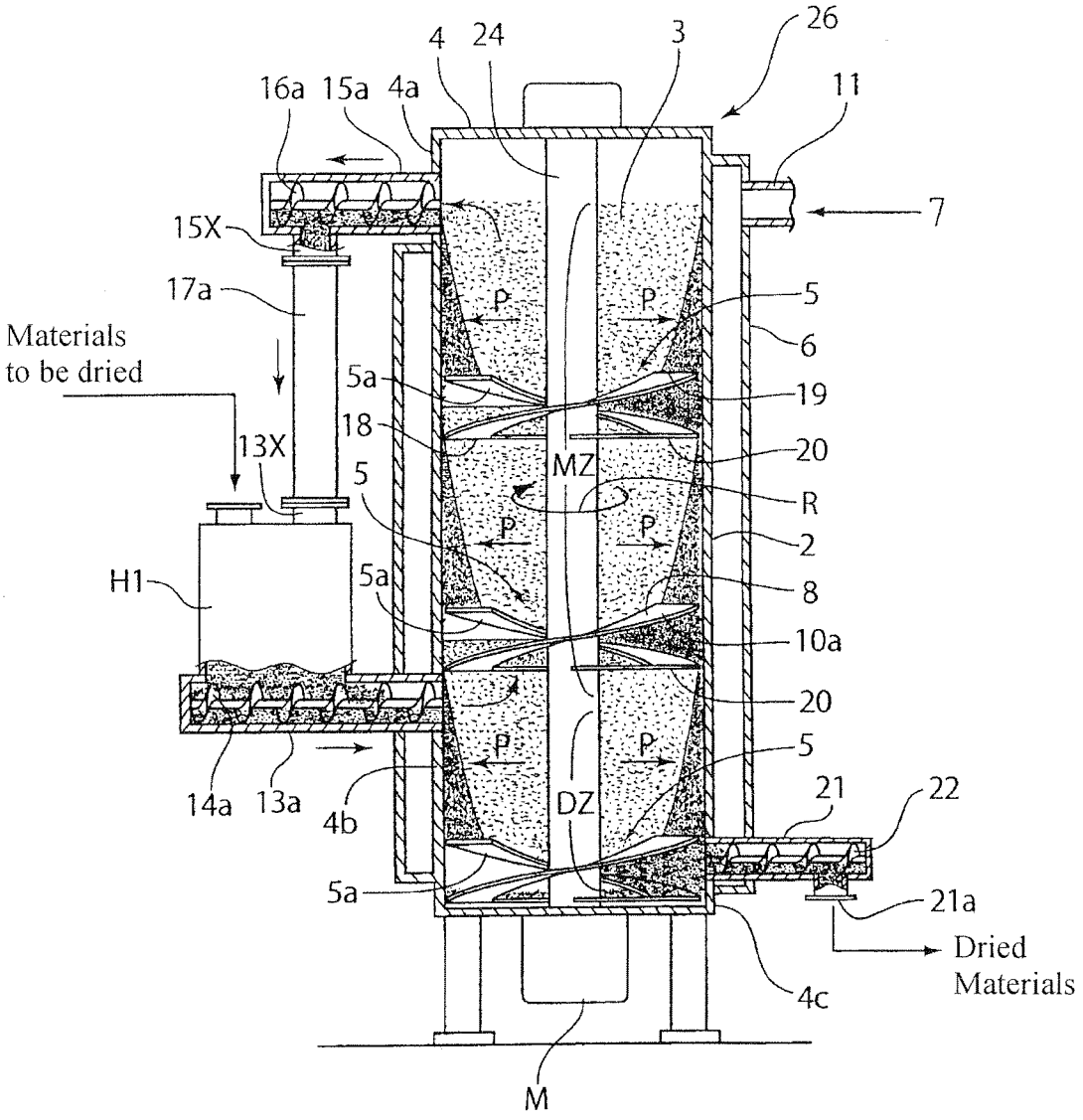
FIG. 2 is a vertical sectional view showing the internal structure of a continuous drying apparatus according to a second embodiment.

A second embodiment of the continuous drying apparatus of the invention is illustrated in vertical section in FIG. 2. Components corresponding to those in the first embodiment are assigned the same reference numbers. Components in other embodiments to be described later are numbered in the same way.

In the continuous drying apparatus 26 of the second embodiment the drying tank 4 has the same structure as that of the first embodiment. An upper screw conveyer 15*a*, having a discharge screw 16*a* therein is provided with a connecting port 15X at the bottom thereof at a location near the end of the conveyor remote from the drying tank 4. The conveyor is connected to the outer surface of the drying tank 4 at a location 4*a* adjacent the upper part of the drying tank. A lower screw conveyer 13*a*, having a supply screw 14*a*, is connected to the outer surface of the drying tank 4 at an intermediate location 4*b*.

The lower screw conveyer 13*a* is provided with a hopper H1, the upper surface of which has a feed port for the materials 3 and a connecting port 13X. A hollow, cylindrical, vertical transfer pipe 17*a* is connected from the connecting port 13X of conveyor 13*a* to the connecting port 15X of conveyor 15*a*.

After being carried out of the mixing and drying zone MZ by the upper screw conveyer 15*a*, the material 3 is collected in the hopper H1, mixed with fresh material 3 therein, and supplied to the bottom of the mixing and drying zone MZ by the screw 14*a* of the lower screw conveyer 13*a*.

Since the vertical transfer pipe 17*a* is connected directly to the upper surface of the hopper H1, the second embodiment has a short-cut transfer route between the upper screw conveyer 15*a* and the lower screw conveyer 13*a*. As in the first embodiment, when the circulated material 3, mixed with fresh material in the hopper H1, is returned into the drying tank 4, the mixture is swirled upward and dried continuously in the mixing and drying zone MZ. The dried materials 3 are continuously transferred out from the bottom of the drying zone DZ by discharge screw conveyer 21 connected to the drying tank at a location 4*c* adjacent the bottom of the drying tank.

Figure 3:
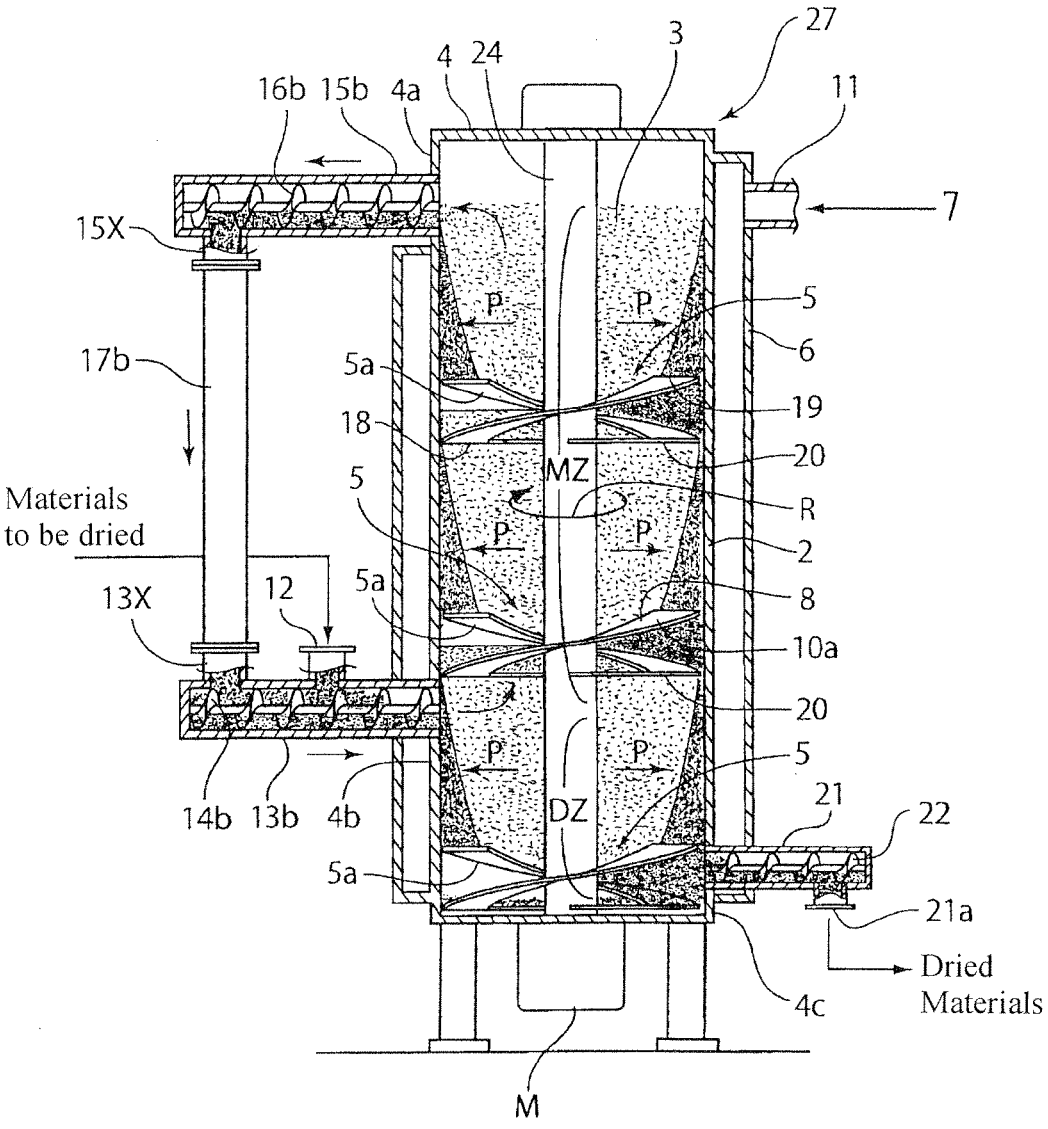
FIG. 3 is a vertical sectional view showing the internal structure of a continuous drying apparatus according to a third embodiment.

In a third embodiment, shown in vertical sectional view in FIG. 3, a continuous drying apparatus 27 according to a third embodiment of the invention comprises a drying tank 4, having the same structure as that of the first embodiment. An upper screw conveyer 15*b*, is connected to the outer surface of the upper part of the drying tank 4 at location 4*a*. The conveyor 15*b* has a discharge screw 16*b* therein, and is provided with a connecting port 15X at its bottom at a location remote from tank 4. A lower screw conveyer 13*b*, having a supply screw 14*b*, is connected to the outer surface of the drying tank 4 at a location 4*b* adjacent the bottom of the mixing and drying zone MZ.

A feed port 12 for the material 3 is provided at an intermediate location on the top of the lower screw conveyer 13*b*. A hollow, cylindrical, vertical transfer pipe 17*b* is connected from a connecting port 13X at the top of the lower screw conveyer 13*b* adjacent the outer end thereof to a connecting port 15X at the bottom of the upper screw conveyer 15*b* adjacent the outer end thereof.

After being drawn out of the upper end of the drying tank by the upper screw conveyer 15*b*, the material 3 is dropped into the lower screw conveyer 13*b* though the vertical transfer pipe 17*b*, and conveyed into the drying tank 4 by the screw 14*b* at a location adjacent the bottom of the mixing and drying zone MZ. Meanwhile, fresh material is introduced into feed port 12 of the screw conveyor 13*b*, and the circulated material along with fresh material to be dried is introduced into the drying tank 4 at a location adjacent the bottom of the mixing and drying zone MZ.

This third embodiment, which has no hopper is particularly suitable for use as a drying apparatus for sludge or liquid material.

Figure 4:
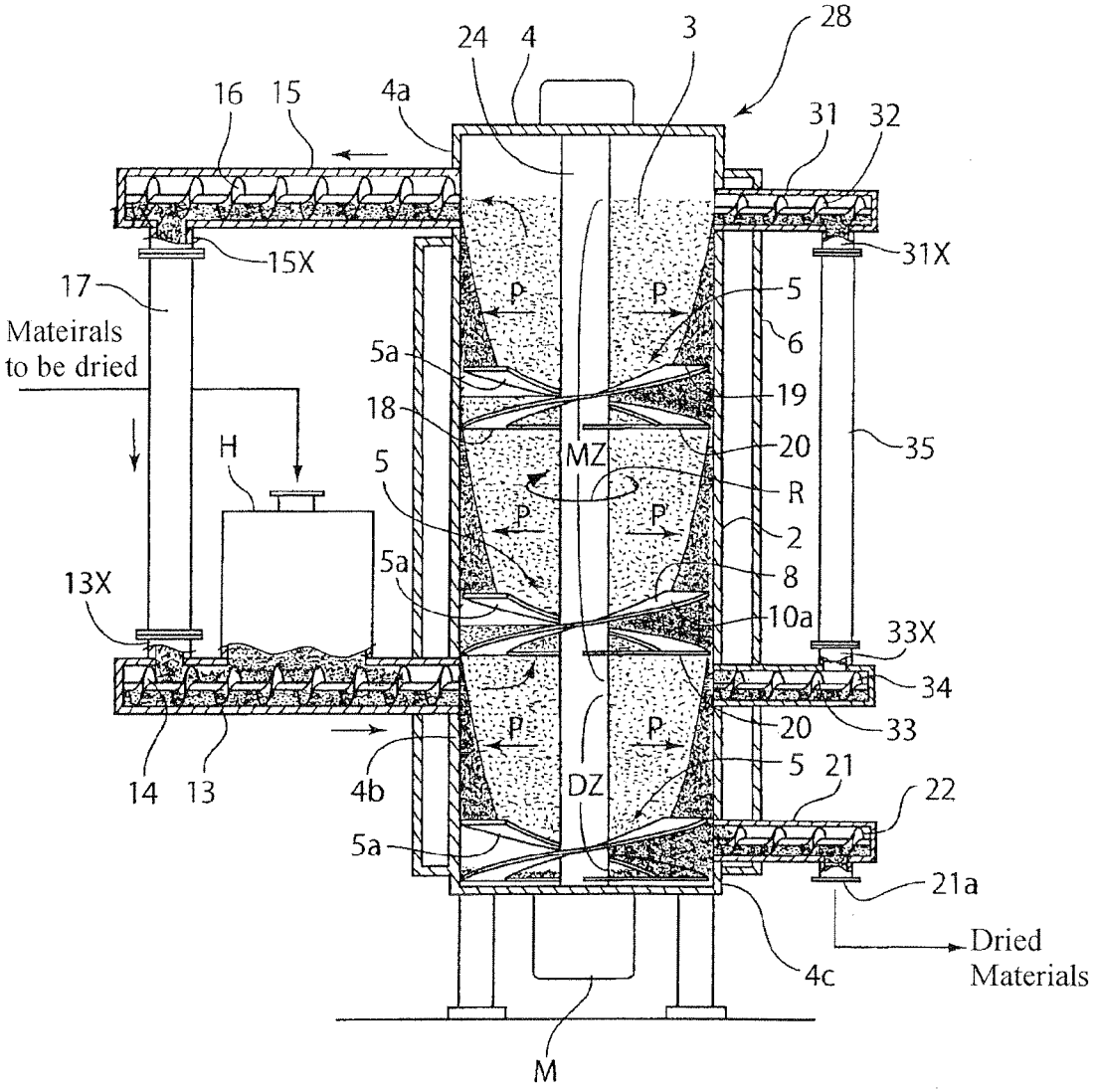
FIG. 4 is a vertical sectional view showing the internal structure of a continuous drying apparatus according to a fourth embodiment.
Figure 5:
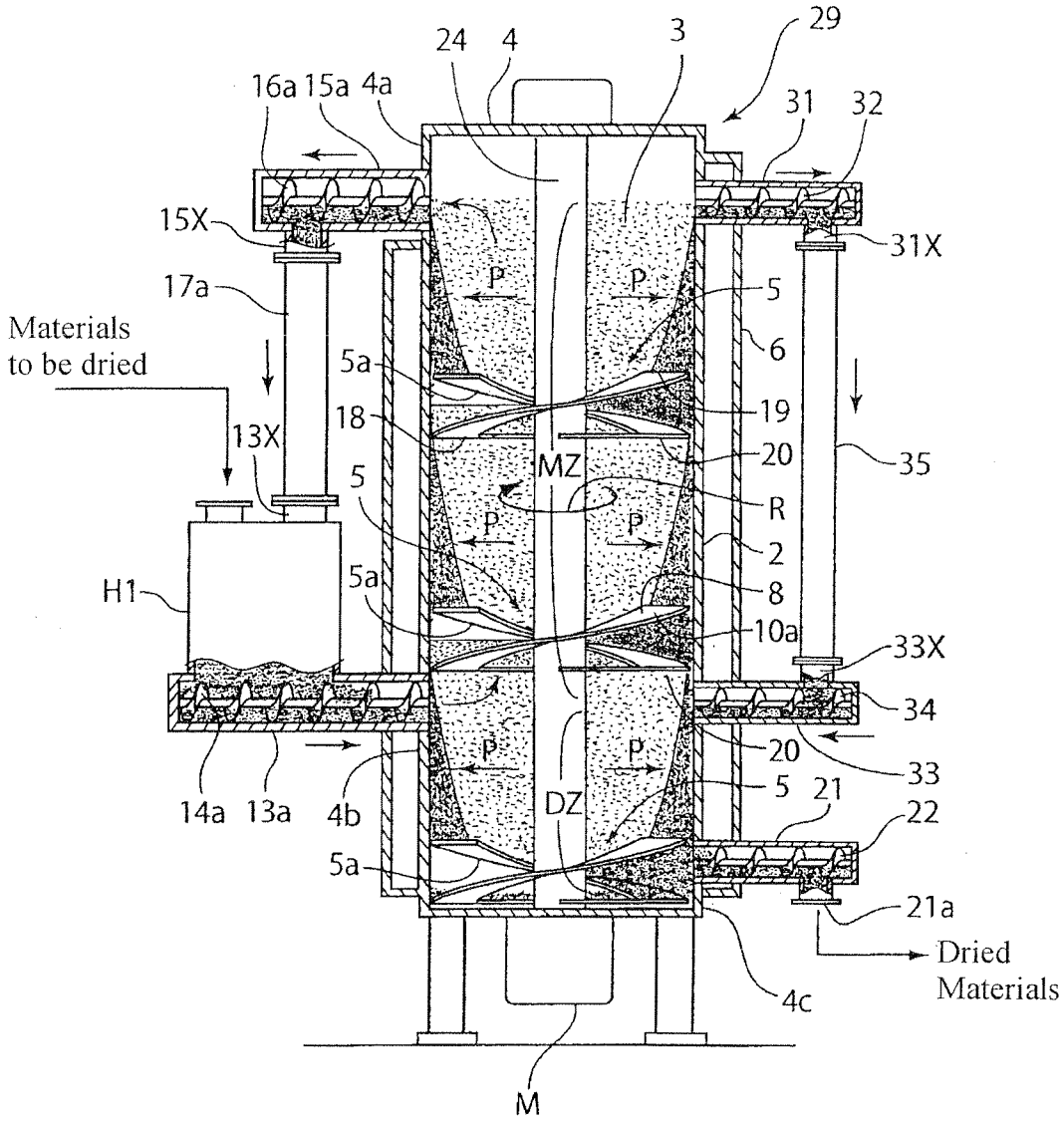
FIG. 5 is a vertical sectional view showing the internal structure of a continuous drying apparatus according to a fifth embodiment.
Figure 6:
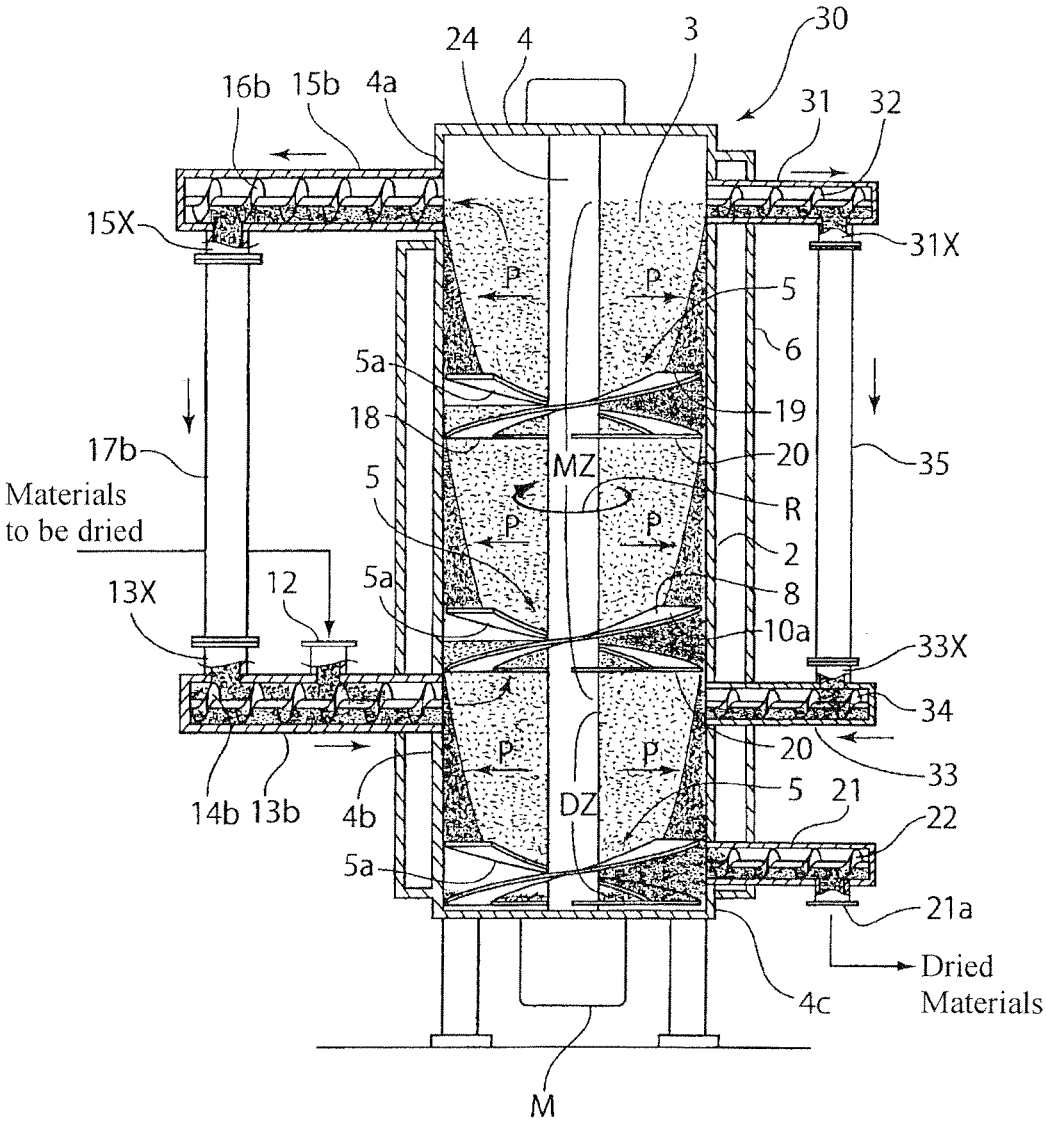
FIG. 6 is a vertical sectional view showing the internal structure of a continuous drying apparatus according to a sixth embodiment.

FIGS. 4-6, are vertical sectional views illustrating, respectively, fourth, fifth and sixth embodiments of the invention, which employ drying tanks that are substantially the same as the drying tank of the first embodiment illustrated in FIG. 1. The structure which differentiates the fourth, fifth and sixth embodiments from the preceding embodiments, and which is common to all the fourth, fifth and sixth embodiments will be described.

In FIGS. 4-6, the reference numbers 28, 29, and 30 designate the continuous drying apparatus of the fourth, fifth and sixth embodiments, respectively. As already described, the continuous drying apparatuses 28, 29, and 30 are provided with upper screw conveyers 15, 15*a*, and 15*b* connected at location 4*a* adjacent the upper part of drying tank 4, and lower screw conveyers 13, 13*a*, and 13*b* connected at location 4*b* adjacent an intermediate part of the drying tank 4.

One or more adjunct upper screw conveyers 31 are connected to the outer surface of the drying tank 4 on the side opposite from the upper screw conveyers 15, 15*a*, and 15*b*. The upper screw conveyors 31 in the illustrated embodiments are located at the same level as the screw conveyors 15, 15*a*, and 15*b*. The screw conveyors 31 can be at levels lower than that of the upper screw conveyors 15, 15*a*, and 15*b*, but should be above the level of the lower screw conveyers 13, 13*a*, and 13*b*. One or more lower adjunct screw conveyers 33, are provided at the same level as, or below, the level of the lower screw conveyers 13, 13*a*, and 13*b*. FIGS. 4-6 show dryers corresponding respectively to the dryers of FIGS. 1-3, each having one adjunct upper screw conveyer 31 and one adjunct lower screw conveyer 33.

A hollow, cylindrical, vertical transfer pipe 35 is connected to a connecting port 31X provided at the bottom of the adjunct upper screw conveyer 31 adjacent the outer end thereof, and a connecting port 33X provided at top of the adjunct lower screw conveyer 33 adjacent the outer end thereof.

Material 3 that travels upward along the inner heating surface of wall 2 to location 4*a* is transferred out of the mixing and drying zone MZ by the upper screw conveyer 15, 15*a* or 15*b*, and returned by screw conveyor 13, 13*a* or 13*b* to the lower part of zone MZ.

Some of the material 3 that travels upward along the inner heating surface of wall 2 to location 4*a* is carried out of the upper part of the mixing and drying zone MZ by screws 32 in one or more adjunct upper screw conveyers 31. The material falls down through a vertical transfer pipe 35 and is returned to the bottom of the mixing and drying zone MZ by a screw 34 in one or more adjunct lower screw conveyers 33.

Thus, each of the fourth, fifth and sixth embodiments is provided with one or more adjunct upper screw conveyers 31, vertical transfer pipes 35, and lower screw conveyers 33, connected to the side of the drying tank 4, as well as the upper screw conveyers 15, 15*a*, and 15*b*, the vertical transfer pipes 17, 17*a*, 17*b*, and the lower screw conveyers 13, 13*a*, and 13*b*. As a result, more material 3 in the mixing and drying zone MZ is swirled up by the rotating rotor blades 5, and hence the apparatus is capable of continuously discharging dried material 3 from the drying zone DZ through the discharge screw conveyer 21 in a shorter time. The rate at which the drying apparatus of the fourth, fifth and sixth embodiments is capable of drying and discharging material increases with an increasing number of adjunct upper screw conveyers 31, vertical transfer pipes 35, and lower screw conveyers 33 connected to the drying tank 4.

Figure 7:
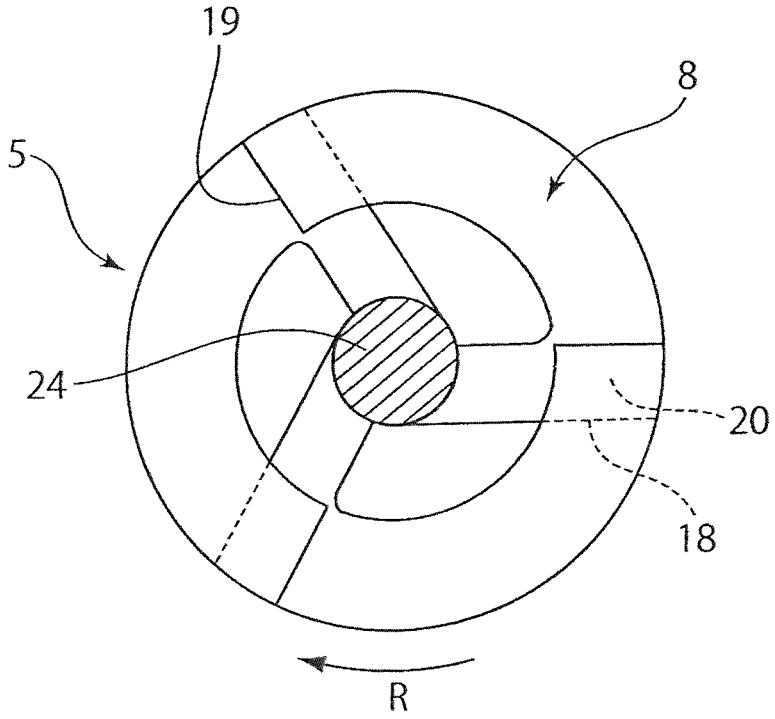
Fig. 7 (PRIOR ART)
FIG. 7 is a plan view of a set of rotor blades comprising three blades.
Figure 8:
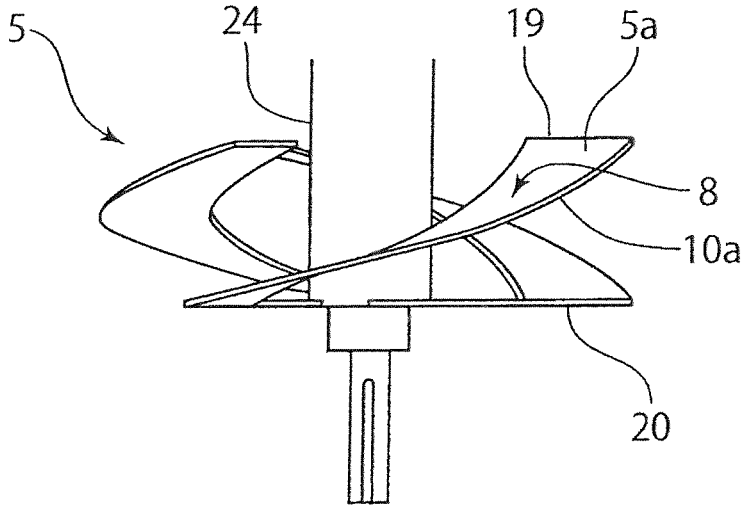
Fig. 8 (PRIOR ART)
FIG. 8 is a side view of the set of rotor blades shown in FIG. 7.

FIGS. 7 and 8 illustrate an example of a set of rotor blades 5 used in each of the above described embodiments. The set of rotor blades comprises three blades, each having the same basic configuration.

Three blades 5*a* are arranged at regular intervals around a central shaft 24 which extends vertically in the center of the drying tank. Each blade 5*a* has a same configuration, and, in plan view, extends through an angle not exceeding 360 degrees. In this case, each blade extends through an angle that slightly exceeds 120 degrees.

Each blade has a lower end 18 and an upper end 19. The lower end 18 is an extension of a scraper 20 fixed on the rotatable central shaft 24. Material is transferred from the lower end to the upper end as the blades are rotated. Each blade has an elongated upper surface 8 which extends from its lower end 18 to its upper end 19, and has a helical peripheral outer edge 10*a* that conforms to, and extends along, the heating surface formed by the cylindrical inner surface of wall 2 of the drying tank.

The surface 8 of each blade extends obliquely upward from the lower end 18 to the upper end 19 of the blade, proceeding in a direction opposite to the direction R of blade rotation. The rotor blades 5 are preferably configured in an overlapping relationship as shown in FIG. 7, and so that the upper end 19 of one blade is positioned higher than the lower end 18 of the following blade. The apparatus dries material 3 by swirling the material up onto the blades and pressing it centrifugally against the heating surface of tank wall 2.

Figure 9:
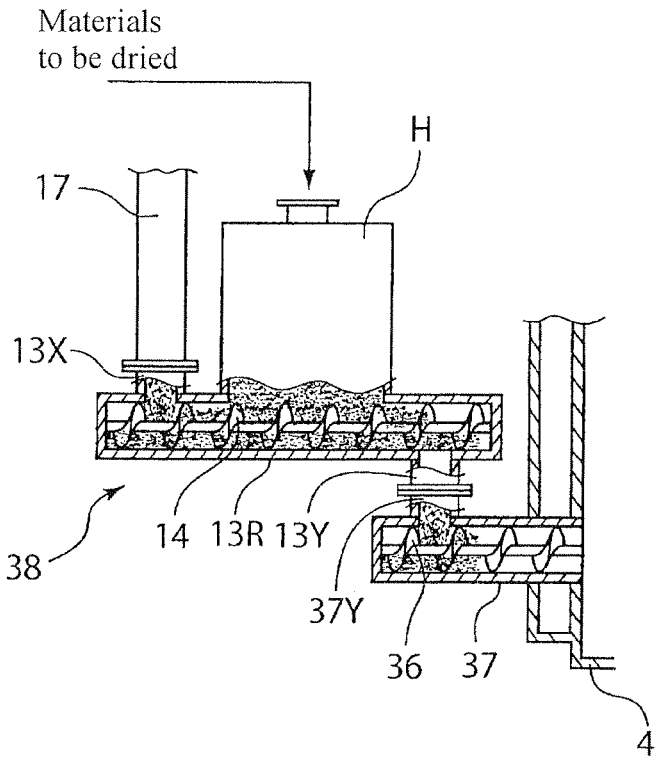
FIG. 9 is a sectional view showing a seventh embodiment, which is a modified version of a lower screw conveyor assembly incorporating first and second screw conveyors connected in series for use in a drying apparatus corresponding to the embodiments of FIGS. 1 and 4.
Figure 10:
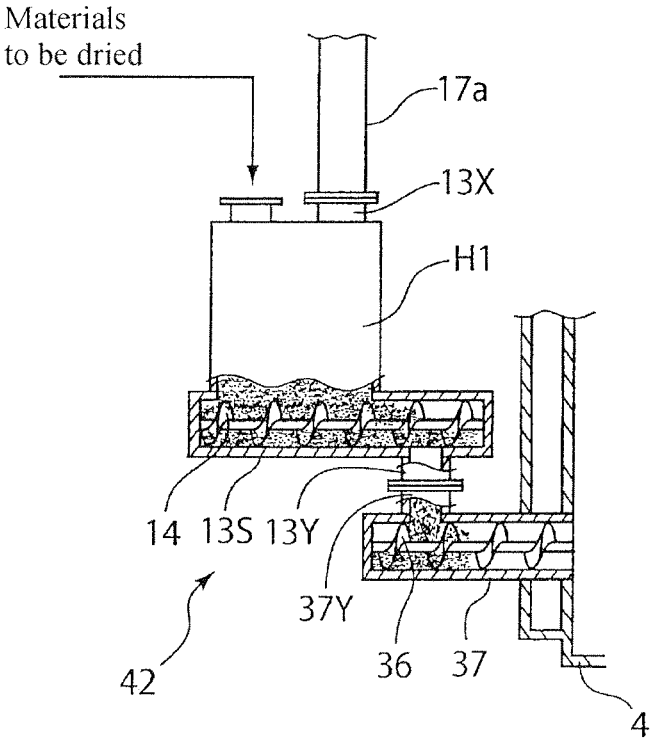
FIG. 10 is a sectional view showing an eighth embodiment, which is a modified version of a lower screw conveyor assembly incorporating first and second screw conveyors connected in series for use in a drying apparatus corresponding to the embodiments of FIGS. 2 and 5.
Figure 11:
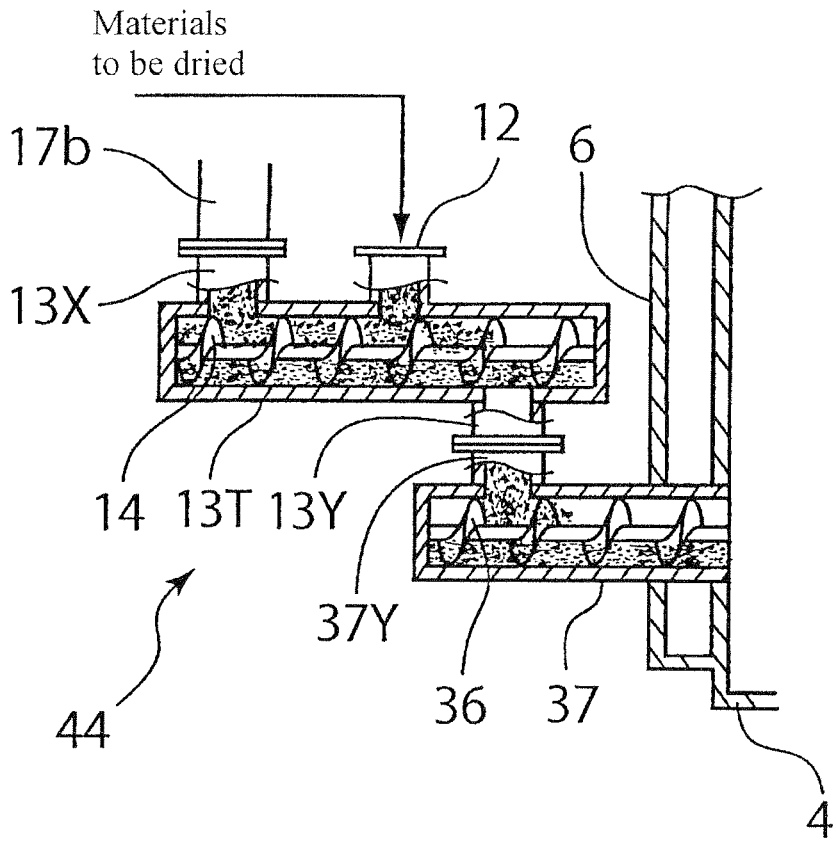
FIG. 11 is a sectional view showing a ninth embodiment, which is a modified version of a lower screw conveyor assembly incorporating first and second screw conveyors connected in series for use in a drying apparatus corresponding to the embodiments of FIGS. 3 and 6.

FIGS. 9-11 show seventh, eighth and ninth embodiments, respectively. Each of these embodiments includes a screw conveyor corresponding to screw conveyors 13, 13*a* and 13*b* in the previously described embodiments. The ends of these screw conveyors toward which the material travels are blocked, and the bottom of the blocked end of each of these screw conveyors is connected to another screw conveyer which is connected to the drying tank 4. Corresponding parts in the seventh, eighth and ninth embodiments are designated by the same reference numbers.

In the seventh embodiment, shown in FIG. 9, which corresponds to the first and fourth embodiments, a two-stage lower screw conveyor 38 is composed of two screw conveyors, 13R and 37, connected in series. One end of screw conveyer 13R is blocked, and its screw 14 carries material toward the blocked end. A branched screw conveyer 37 is connected to a connecting port 13Y adjacent the blocked end of screw conveyer 13R at the bottom thereof. The top of the branched screw conveyer 37 has a connecting port 37Y adjacent a blocked upstream end. Connecting port 37Y is connected to port 13Y, and the opposite end of screw conveyor 37 is connected to the side of the drying tank 4 so that its screw 36 can deliver material into an intermediate location in the drying tank.

In this two-stage screw conveyer 38, material dropped from an upper screw conveyer corresponding to conveyor 15 in FIGS. 1 and 4 and fresh material fed into a hopper H, are transferred through the screw conveyer 13 by a screw 14 toward the blocked end, where material drops down into the branched screw conveyer 37 through connecting ports 13Y and 37Y, and is supplied by conveyor 36 to an intermediate location in the drying tank 4.

In this seventh embodiment of the invention, material returned from the drying tank by an upper screw conveyer, and fresh material fed into the hopper H, are broken up to pieces while being transferred by conveyor 13R to the branched screw conveyer 37. This embodiment is effective in improving the mobility of the material to be dried, especially where the material in the form of a sludge or blocks.

In the eighth embodiment, shown in FIG. 10, which corresponds to the second and fifth embodiments, a two-stage lower screw conveyor 42 is composed of two screw conveyors, 13S and 37, connected in series. One end of screw conveyer 13S is blocked, and its screw 14 carries material toward the blocked end. A branched screw conveyer 37 is connected to a connecting port 13Y adjacent the blocked end of screw conveyer 13S at the bottom thereof. The top of the branched screw conveyer 37 has a connecting port 37Y adjacent a blocked upstream end. Connecting port 37Y is connected to port 13Y, and the opposite end of screw conveyor 37 is connected to the side of the drying tank 4 so that its screw 36 can deliver material into an intermediate location in the drying tank. The two stage lower screw conveyor 42 according to the eighth embodiment has the same functions and effects as the two stage lower screw conveyor 38 of the seventh embodiment.

In the ninth embodiment, shown in FIG. 11, which corresponds to the third and sixth fourth embodiments, a two-stage lower screw conveyor 44 is composed of two screw conveyors, 13T and 37, connected in series. One end of screw conveyer 13T is blocked, and its screw 14 carries material toward the blocked end. A branched screw conveyer 37 is connected to a connecting port 13Y adjacent the blocked end of screw conveyer 13T at the bottom thereof. The top of the branched screw conveyer 37 has a connecting port 37Y adjacent a blocked upstream end. Connecting port 37Y is connected to port 13Y, and the opposite end of screw conveyor 37 is connected to the side of the drying tank 4 so that its screw 36 can deliver material into an intermediate location in the drying tank. The second lower screw conveyer 44 according to the ninth embodiment of the invention of this embodiment has the same functions and effects as the seventh and eighth embodiments.

Figure 12:
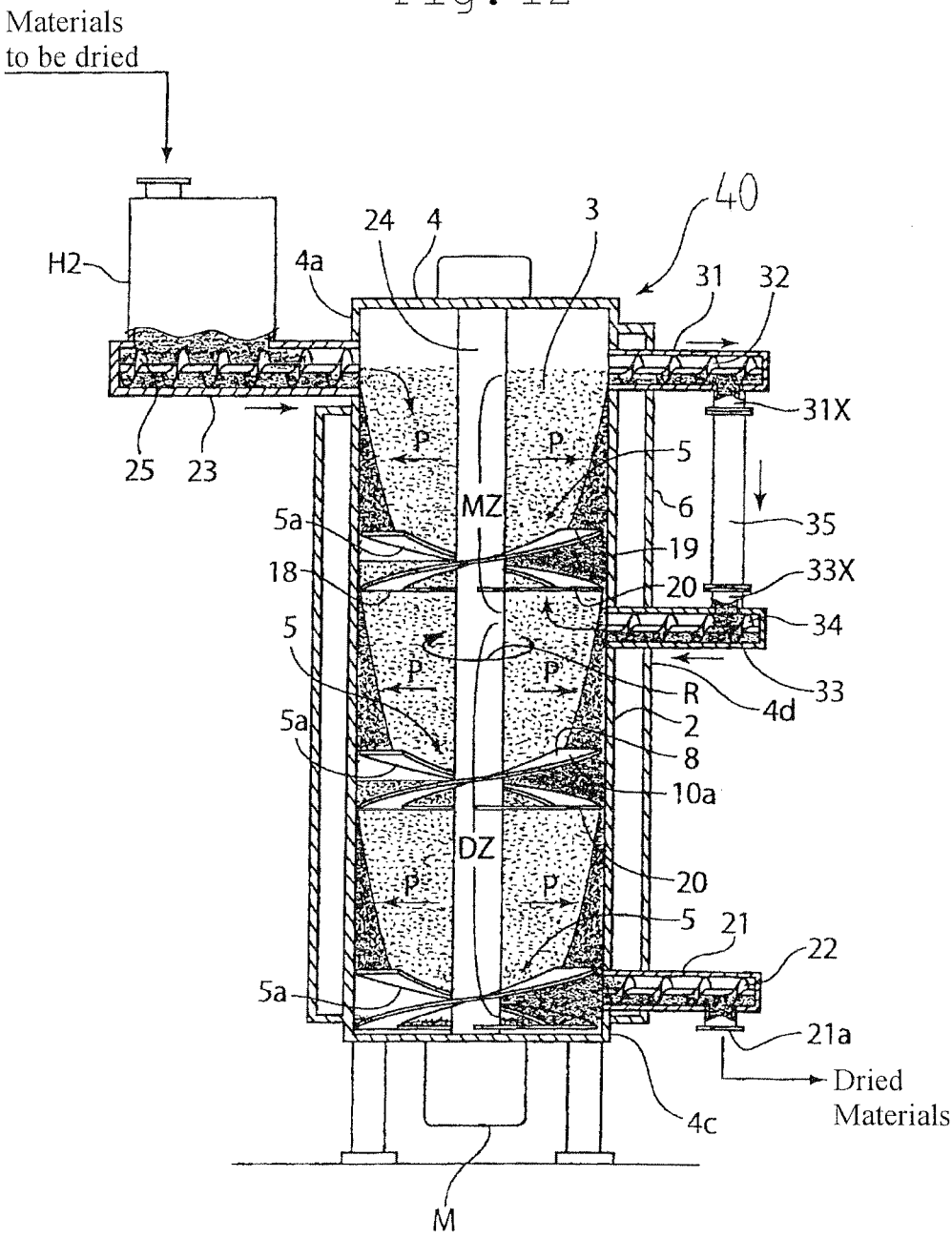
FIG. 12 is a vertical sectional view showing the internal structure of a continuous drying apparatus according to a tenth embodiment of the invention.

A tenth embodiment, illustrated in FIG. 12, has adjunct screw conveyors similar to those of the fourth, fifth and sixth embodiments shown in FIGS. 4-6. In this continuous drying apparatus 40, an upper screw conveyer 23, having a screw therein, has an exit end connected at a location 4*a* to the outer surface of the upper part of a drying tank 4. A hopper H2 having a feed port for introduction of material 3 is provided on a part of the upper screw conveyer 23 at a location spaced form the exit end of the screw conveyor.

One or more adjunct upper screw conveyers 31 are connected to the upper part 4*a* of the drying tank 4, and a corresponding adjunct lower screw conveyer 33 is connected to the drying tank 4 at an intermediate location 4*d* of the drying tank 4 directly below each upper screw conveyer 31.

Each upper screw conveyer 31 has a connecting port 31X at the bottom near a blocked end thereof. This connecting port 31X is connected to a connecting port 33X on the top of each lower screw conveyer 39 through a hollow, cylindrical, vertical transfer pipe 35.

In this embodiment, because the adjunct lower screw conveyor 33 is positioned at a relatively high intermediate location on the drying tank 4 compared to the locations of the conveyors 33 in FIGS. 4-6, the drying zone DZ extends through a longer range from the bottom of the tank, while the mixing and drying zone MZ extends through a shorter range from the upper end of zone DZ toward the top of the tank.

In the operation of the continuous drying apparatus 40, materials 3, thrown into the hopper H2, is supplied into the drying tank 4, at location 4*a* through the upper screw conveyer 23 by a screw 25.

The material 3, supplied to the drying tank 4 by the upper screw conveyer 23, drops down by gravity through the blades initially in a resting condition and piles up at the bottom of the drying tank 4 adjacent location 4*c*. The material piled up at the bottom of the drying tank is swirled upward by rotation of the rotor blades 5. In this process, the material is pressed centrifugally against the heating surface of wall 2, and swirled upward from the drying zone DZ to the top of the mixing and drying zone MZ.

The material 3 is dried to a certain extent while being swirled upward to the top of the mixing and drying zone MZ. There it is carried out by screws 32 in one or more adjunct upper screw conveyers 31, and drops down into the corresponding adjunct lower screw conveyers 33 though the vertical transfer pipes 35.

After dropping into the adjunct lower screw conveyers 33, the material 3 is returned by screws 34 to the drying tank at the bottom of the mixing and drying zone MZ and dried as it is mixed and swirled upward to the top together with material swirled upward from the drying zone DZ.

In this embodiment, since the drying tank 4 has its material supply port at a location 4*a* adjacent the top of the drying tank, the material 3 is dried to a certain extent by radiant heat as it falls down from the supply port toward the bottom of the drying tank 4. The material at the bottom is dried further in the drying zone DZ as it is rotated by blades 5.

Drying of the material 3 is accelerated because the material is swirled upward to the top of the tank, circulated in a short cycle through the adjunct upper screw conveyer 31, the vertical transfer pipe 35, the adjunct lower screw conveyer 33, and the relatively short mixing and drying zone MZ. This drying apparatus can dry more material 3 more rapidly, if the drying tank 4 is equipped with additional more adjunct upper screw conveyers 31, vertical transfer pipes 35, and adjunct lower screw conveyers 33.

Moreover, when the drying apparatus is activated, the material 3 in the hopper H2, which has a high water content, is sent into the thin layer of material pressed against the heating surface of wall 2 as by the rotating upper blades 5*a*. Accordingly, even when the material falls down by gravity after being fed into the tank by the screw conveyer 23, the material is immediately swirled upward to the mixing and drying zone MZ. As a result, much of the newly supplied material is dried in the upper mixing and drying zone MZ, whereas the material 3 in the drying zone DZ contains much of the already-dried and powdery materials and a relatively small amount of newly supplied material.

The materials 3 at the bottom of the drying tank 4 is continuously transferred out of the drying tank by the discharge screw conveyer 21 connected to the tank near the bottom thereof at location 4*c*.

Figure 13:
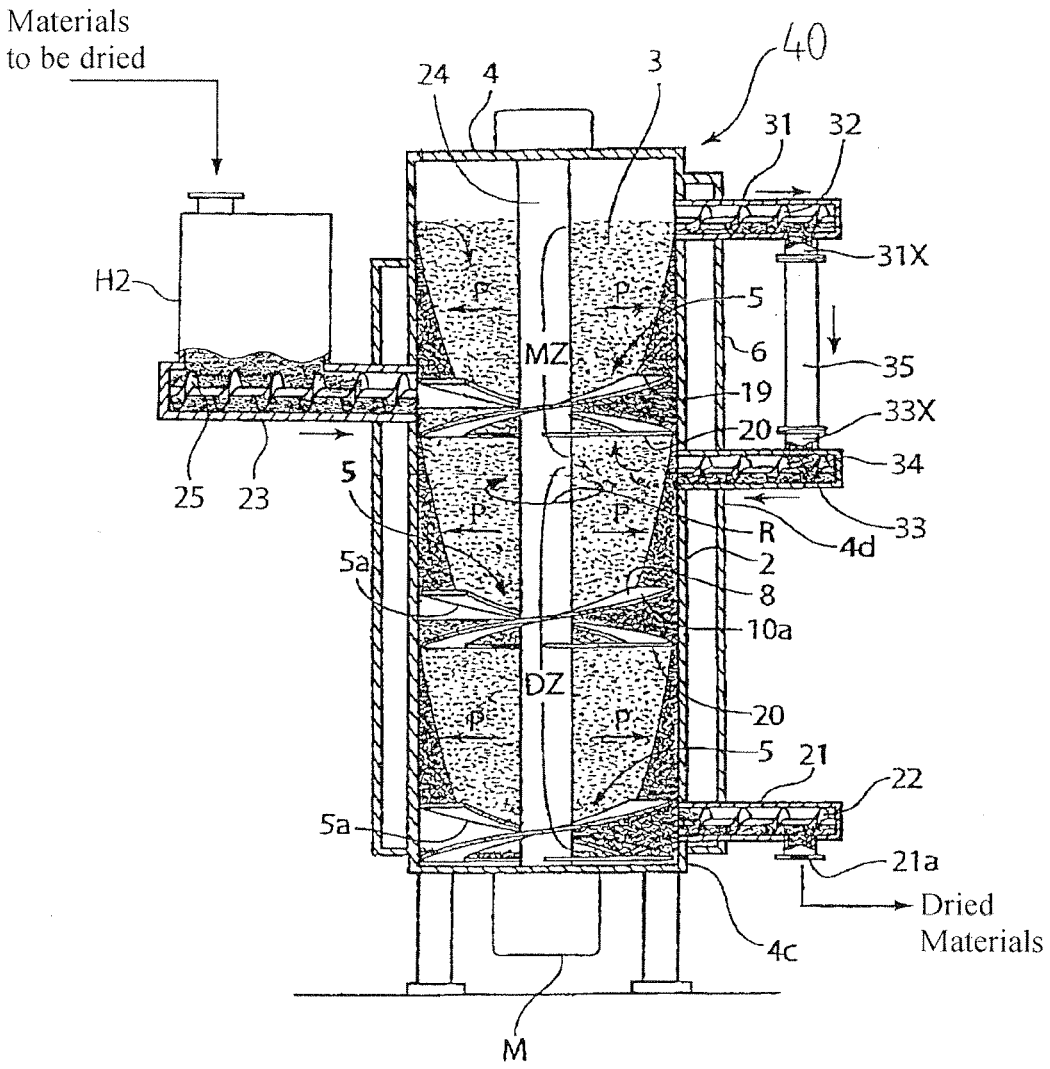
FIG. 13 is vertical sectional view showing the internal structure of a continuous drying apparatus according to an eleventh embodiment.

An eleventh embodiment, illustrated in FIG. 13, differs from the tenth embodiment illustrated in FIG. 12 in that the upper screw conveyer 23, through which material to be dried is supplied to the drying tank, is positioned at a location well below the top of the tank, and slightly higher than the location of the adjunct lower screw conveyer 33. The upper screw conveyer 23 can be disposed at any of various heights, depending on the properties of the material to be dried, especially its water content, viscosity, particle size, or the size of its blocks if in block form. Otherwise, the eleventh embodiment has the same structure as that of the tenth embodiment 4 shown in FIG. 12.

Figure 14:
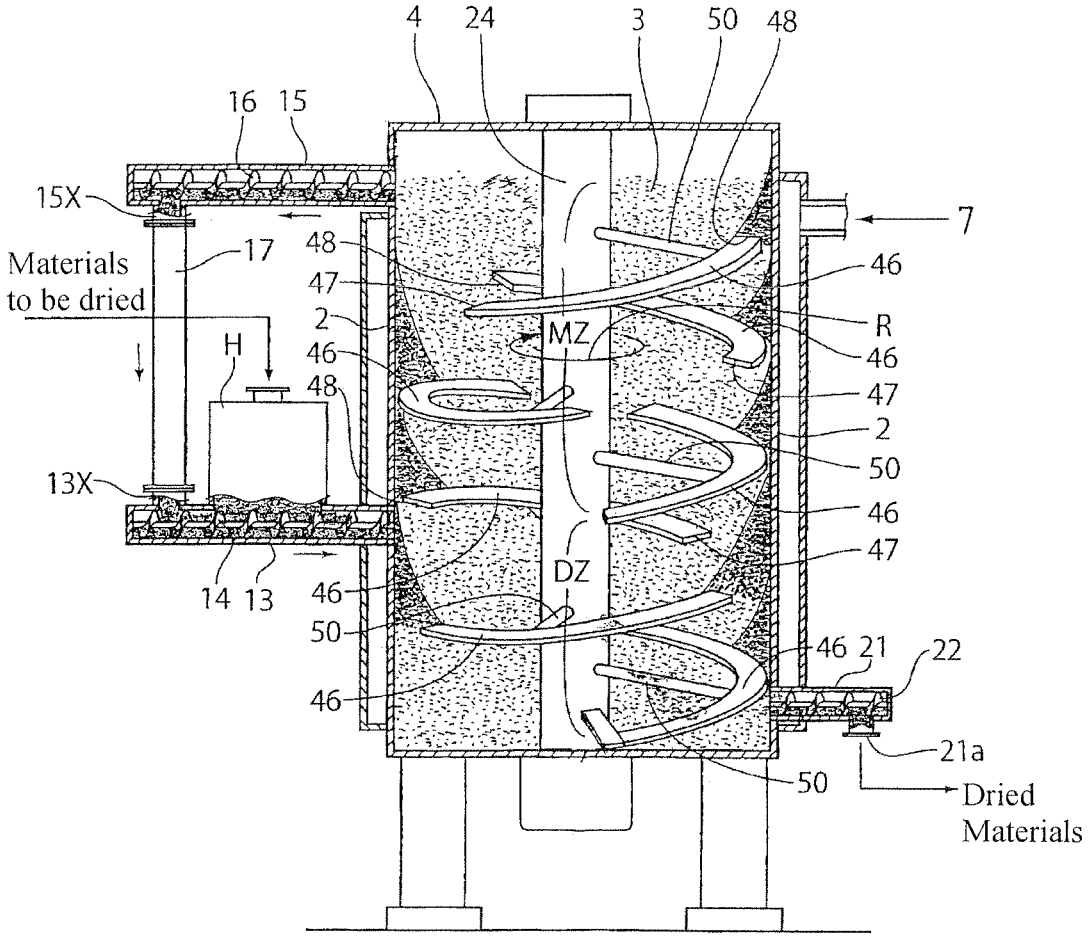
FIG. 14 is a vertical sectional view showing the internal structure of a continuous drying apparatus according to a twelfth embodiment, having rotor blades different from those in the first eleven embodiments.

In a twelfth embodiment shown in FIG. 14, the continuous drying apparatus has rotor blades 46 mounted on a rotary shaft 24 in a drying tank. Each rotor blade has a lower end 47 and an upper end 48, and is mounted on an arm 50 by which it is connected to shaft 24. Materials can be dried continuously using this type of rotor blade.

The rotor blades of this continuous drying apparatus may have various configurations: a single blade, a plurality of blades disposed at the same level, or a plurality of tiers of the rotor blades, each tier comprising a plurality of blades. The invention provides a continuous drying apparatus applicable to all types of the rotor blades which are capable of swirling up material thereon and pressing the material centrifugally against the heated inside wall of a cylindrical tank.

What is claimed is:

1. A continuous drying apparatus comprising:

a vertical cylindrical drying tank;

heating means surrounding said drying tank, for heating an inner surface of said drying tank for transfer of heat from said heating means to material within the tank to be dried; and rotor blades mounted for rotation in said drying tank to swirl material in the drying tank upward by their rotation and to bring said material into contact with said inner heating surface;

wherein the interior of said drying tank is composed of a mixing and drying zone in which mixing and drying of material supplied to the tank takes place by swirling of the material upward onto one or more of said blades and centrifugally pressing the material against said inner surface, and a drying zone beneath said mixing and drying zone;

the continuous drying apparatus also including:

an upper screw conveyor connected to an upper part of the mixing and drying zone and arranged to transfer material swirled upward by rotation of the rotor blades out of the mixing and drying zone;

a lower screw conveyor connected to the drying tank at an intermediate location between the top and bottom thereof for supplying material into the drying tank, said lower screw conveyor comprising a rotatable screw;

a wet material passage for introducing wet material to be dried into the lower screw conveyor;

a vertical transfer pipe connected between said upper screw conveyor and said lower screw conveyor to transfer materials transferred out of the mixing and drying zone by the upper screw conveyor down to the lower screw conveyor, said vertical transfer pipe having an exit above, and in communication with, the lower screw conveyor, whereby said materials transferred by the vertical transfer pipe are dropped through the vertical transfer pipe, passed downward by gravity from said exit into the lower screw conveyor, and combined with said wet material; and a discharge screw conveyor connected to said drying zone for discharging material continuously from the drying zone.

2. A continuous drying apparatus as claimed in claim 1, in which said lower screw conveyor connected to the drying tank at an intermediate location comprises a first screw conveyor having a blocked downstream end and a branched screw conveyor connected to a location on said first screw conveyor adjacent the blocked downstream end thereof for receiving material from said first screw conveyor, and connected to deliver said material to the interior of the drying tank.

3. A continuous drying apparatus comprising:

a vertical cylindrical drying tank;

heating means surrounding said drying tank, for heating an inner surface of said drying tank for transfer of heat from said heating means to material within the tank to be dried; and rotor blades mounted for rotation in said drying tank to swirl material in the drying tank upward by their rotation and to bring said material into contact with said inner heating surface;

wherein the interior of said drying tank is composed of a mixing and drying zone in which mixing and drying of material supplied to the tank takes place by swirling of the material upward onto one or more of said blades and centrifugally pressing the material against said inner surface, and a drying zone beneath said mixing and drying zone;

the continuous drying apparatus also including:

an upper screw conveyor connected to an upper part of the mixing and drying zone and arranged to transfer material swirled upward by rotation of the rotor blades out of the mixing and drying zone;

a lower screw conveyor connected to the drying tank at an intermediate location between the top and bottom thereof for supplying material into the drying tank;

a vertical transfer pipe connected between said upper screw conveyor and said lower screw conveyor to transfer materials transferred out of the mixing and drying zone by the upper screw conveyor down to the lower screw conveyor; and a discharge screw conveyor connected to said drying zone for discharging material continuously from the drying zone;

in which said drying tank has at least one adjunct upper screw conveyor connected thereto above the level of said lower screw conveyor for taking material out of said drying tank, and at least one adjunct lower screw conveyor connected to the drying tank at the same level as, or below the level of, said lower screw conveyor for introducing material into said drying tank, and a vertical transfer pipe connected between the adjunct upper screw conveyor and the adjunct lower screw conveyor to transfer materials taken out of the drying tank by the adjunct upper screw conveyor down to the adjunct lower screw conveyor.

4. A continuous drying apparatus as claimed in claim 3, in which said lower screw conveyor connected to the drying tank at an intermediate location comprises a first screw conveyor having a blocked downstream end and a branched screw conveyor connected to a location on said first screw conveyor adjacent the blocked downstream end thereof for receiving material from said first screw conveyor, and connected to deliver said material to the interior of the drying tank.

* * * * *